US005962110A

United States Patent [19]

Penke-Wevelhoff

[11] Patent Number: 5,962,110

[45] Date of Patent: Oct. 5, 1999

[54] TRANSFER IMAGES

[75] Inventor: Hans-Peter Penke-Wevelhoff, Holzminden, Germany

[73] Assignee: Heyne & Penke GmbH & Co., Holzminden, Germany

[21] Appl. No.: 08/811,690

[22] Filed: Mar. 5, 1997

[30] Foreign Application Priority Data

| | | | |
|---|---|---|---|
| Mar. 6, 1996 | [DE] | Germany | 296 04 116 U |
| Sep. 16, 1996 | [DE] | Germany | 296 16 117 U |

[51] Int. Cl.[6] ..... B41M 5/40

[52] U.S. Cl. ..... 428/195; 428/211; 428/342; 428/447; 428/480; 428/913; 428/914

[58] Field of Search ..... 428/195, 352, 428/447, 913, 914, 211, 342, 480

[56] References Cited

U.S. PATENT DOCUMENTS

| | | | |
|---|---|---|---|
| 4,421,816 | 12/1983 | Arnold | 428/202 |
| 4,522,864 | 6/1985 | Humason et al. | 428/201 |
| 5,393,590 | 2/1995 | Caspari | 428/195 |

FOREIGN PATENT DOCUMENTS

| | | | |
|---|---|---|---|
| 0 043 578 A2 | 1/1982 | European Pat. Off. | 428/195 |
| 559 019 | 2/1975 | Switzerland | 428/195 |
| WO 91/03381 | 3/1991 | WIPO | 428/195 |
| WO 93/11734 | 6/1993 | WIPO | 428/195 |
| WO 95/02344 | 1/1995 | WIPO | 428/195 |

*Primary Examiner*—Bruce H. Hess
*Attorney, Agent, or Firm*—Scully, Scott, Murphy & Presser

[57] ABSTRACT

Transfer images or decalcomania pictures, and method of producing the transfer images or pictures. The transfer pictures can be made from a roll of material or from sizes of material of flexible paper or such plastics which connected with a separating layer, which is coated with a transfer lacquer, which in the composite of the materials are imprinted on the front side, and upon occasion on the rear side with different pictorial motifs, by liquid printing colors, and which in the combination of the system of the components are interconnected with such an adhesive which does not require an addition of water, preferably by means of an adherent-melt adhesive or a water-soluble adhesive in the form of an emulsion or dispersion, especially a cover paper or cover foil of a plastic based on polyacrylate, and with the paper being an adhesive-retardant, silicone-coated transparent cover paper, which after removal thereof can be applied without the addition of water as an applique with a light pressure, such as through hand pressure onto other surfaces, such as glass or wood, and in particular onto human skin surfaces.

9 Claims, No Drawings

TRANSFER IMAGES

BACKGROUND OF THE INVENTION

The present invention relates to transfer images or decalcomania pictures, and also relates to a method of producing the transfer images.

Currently known transfer images or pictures which are produced in accordance with the present state of the technology, for the application thereof onto surfaces necessitate the case of suitable solvent media or a moistening with water. These disadvantages are avoided through the intermediary of the transfer images or pictures pursuant to the invention.

In contrast with the prior art or current state of the technology, the transfer images pursuant to the invention eliminate the necessity for providing such auxiliary means or aids. Through the utilization of such auxiliary means or aids there can be encountered a partial damaging of the picture motif, through a only partial release or transference. Furthermore, chemical solvents may not be compatible with the skin, and thereby restrict the application thereof. An excessively applied or dosed moistening can lead due to a softening to a distorted application during the peeling off or transfer of the image. In addition thereto, in the prior art there is encountered the further disadvantage that the solvent or water must evaporate up to the drying of the transferred picture motive at a considerable expenditure or delay in time.

In contrast therewith, the transfer image or picture pursuant to the invention affords the advantage of a secure manipulation during the peeling off for transferring to surfaces, inasmuch as it remains in its original condition.

According to the state of the art, known as skin coloring pictures are the so-called tattoo pictures or images. These are printed on paper by means of water-soluble colors. For this purpose, either the picture or the surface, such as the skin, must be moistened. By means of the moisture, the printed color is again released and partially transferred. Such transfers evidence weakenings in the colors and, consequently, they are of an unclear or blurry representation. Pursuant to the state of the technology, also known are transfer pictures or images in the form of so-called sliding pictures. In that instance a thin imprinted foil of a silicone-containing paper is detached or released through water and slid onto another surface. Such transfers of the motif require a method of transfer which can be implemented only with great difficulty.

Furthermore, pursuant to the state of the technology, under the concept of stickers there is to be understood this relates to adhesive labels. In these, the motif or design is printed on the rear side of a paper which is coated with an adhesive, and which is then covered with a silicone-containing paper. Such products are subject to the disadvantage of possessing an excessive degree of stiffness.

SUMMARY OF THE INVENTION

These disadvantages which are encountered in the state of the technology are avoided by the transfer picture or image pursuant to the invention.

The object of the invention is the formation of transfer images or pictures with different designs or motifs. It is an object to so develop the transfer images or pictures of the invention as to evidence a color strength and which enable the precise imaging through transferring onto smooth, even or curved surfaces.

DETAILED DESCRIPTION OF PREFERRED EMBODIMENTS

The transfer pictures or images pursuant to the invention are set forth in detail hereinbelow, and also various specific aspects thereof. For example, transfer pictures can be characterized that these are made from a roll of material or from sizes of material of flexible paper or such plastics which connected with a separating layer, which is coated with a transfer lacquer, which in the composite of the materials are imprinted on the front side, and upon occasion on the rear side with different pictorial motifs, by means of liquid printing color, and which in the combination of the system of the components are interconnected with such an adhesive which does not require an addition of water, preferably by means of an adherent-melt adhesive or a water-soluble adhesive in the form of an emulsion or dispersion, especially a cover paper or cover foil of a plastic based on polyacrylate, and with the paper being an adhesive-retardant, silicone-coated transparent cover paper, in which after removal thereof can be applied without the addition of water as an applique with a light pressure, such as through hand pressure onto other surfaces, such as glass or wood, and in particular onto human skin surfaces.

For example, the materials of the composite from the components of the transfer image of the invention consist of the following commercially available products.

The flexible paper of the transfer image of the invention consists in particular of satinized twist or waste wool paper with an additional (polyethylene) plastic coating. The twist paper has preferably a weight of 30 to 45 grams per square meter ($g/m^2$) with a coating of 20 grams per square meter.

The flexible plastic material consists of polyester (PE). The transparent cover paper consists of siliconized paper of 40 grams per square meter.

Furthermore, the printing color is based on cellulose (NC). Commercially available is also the adherent-melt adhesive. The water soluble adhesive is based on polyacryl. Other commercial products are suitable for producing the transfer images or pictures pursuant to the invention, when these facilitate the combination of the system with adhesives that they do not require any addition of water in the utilization thereof.

Of considerable significance is the confirming of the compatibility of the transfer images of the invention with the skin. Otherwise, the transfer onto the skin would not be possible, and this would cause a restriction in the use thereof.

EXAMPLE

In a study by the Institute of the CREACHEM GmbH, Holzminden, Germany; 50 volunteers participated of which 21 were subject to allergies. The testing for compatibility with the skin was carried out on the upper arm. The transfer picture or image pursuant to the invention was transferred by means of light pressure from the cover paper to the skin. The removal of the test pictures was carried out after 40, 72, and 90 hours subsequent to the application. In addition to the test image, there was also applied a plain plaster bandage and two known skin-compatible standard products as a negative standard. The standard products were oil-in-water and water-in-oil emulsions available as commercial products.

After up to 90 hours all of the samples did not cause any kind of itching reaction on the skin of the 50 volunteers. The evaluating scale was 0 at an evaluation of 0–5; at which 0=no irritation; 1=weak erythema; 2=clearly ascertainable erythema (also articular); 3=intense erythema papulae formation; 4=densely formed papulae/vesicles; 5=blister formations/necroses.

Confirmed by this research institute for cosmetics and pharmacology was a very good compatibility with the skin by the transfer images of the invention. This was also substantiated in the actual practice of the invention.

The transfer image or picture pursuant to the invention affords the advantage of a lower demand on materials. The transfer image of the invention also affords the advantage that there is a reduction in investment costs in comparison with the state of the art. A further advantage consists of that due to a reduction in the application weight of the adhesive melt material, there are reduced the material costs. A further technical advantage consists of in the increase of the throughput or manufacturing capacity in the transfer images. The transfer image of the invention also reduces the demands on removal.

What is claimed is:

1. A transfer image disposed on paper or plastic comprising a material selected from the group consisting of flexible paper and flexible plastic; a first separating lacquer coating disposed over said material; a water-based printing color defining a pictorial image disposed on said separating lacquer; a melt adhesive disposed over said printing color to bind said printing color to said first separating lacquer coating; and a non-adhesive transparent silicone-coated paper disposed atop said melt adhesive, said transfer image being transferable at ambiant temperature.

2. A transfer image in accordance with claim 1 wherein said material is flexible paper.

3. A transfer image in accordance with claim 2 wherein said flexible paper is 30 to 45 grams per square meter satinized paper provided with a plastic coating.

4. A transfer image in accordance with claim 3 wherein said plastic coating of said flexible paper is polyethylene and said flexible paper is supplied from a roll.

5. A transfer image in accordance with claim 1 wherein said material is a flexible plastic.

6. A transfer image in accordance with claim 5 wherein said flexible plastic material is polyester and said flexible paper is supplied from a roll.

7. A transfer image in accordance with claim 1 wherein said water-based printing color defining said pictorial image is cellulose-based.

8. A transfer image in accordance with claim 1 wherein said transparent silicone-coated paper is 40 grams per square meter siliconized paper.

9. A transfer image in accordance with claim 1 comprising a second separating transfer lacquer coating disposed on the side of said material opposite the side upon which said first separating lacquer coating is disposed; a water-based printing color defining a pictorial image disposed on said second separating lacquer coating; a melt adhesive disposed over said printing color to bind said printing color to said second separating transfer lacquer coating; and a non-adhesive transparent silicone-coated paper disposed atop said melt adhesive.

* * * * *